United States Patent [19]

Bennett

[11] 4,031,774

[45] June 28, 1977

[54] MOLDED MEMBER FOR USE IN WINDING MECHANISMS

[75] Inventor: Robert A. Bennett, Easton, Conn.

[73] Assignee: Waterbury Lock & Specialty Company

[22] Filed: Mar. 19, 1976

[21] Appl. No.: 668,459

[52] U.S. Cl. ..... 74/547; 29/453; 33/138; 242/84.8

[51] Int. Cl.[2] ..... G05G 1/00

[58] Field of Search ..... 74/547; 242/84.8, 84.1 J; 33/138; 29/453; 138/97

[56] References Cited

UNITED STATES PATENTS

| | | | |
|---|---|---|---|
| 531,701 | 1/1895 | Smith | 29/453 UX |
| 702,439 | 6/1902 | Keuffel | 242/84.8 |
| 791,759 | 6/1905 | Eddy | 242/84.8 |
| 2,108,554 | 2/1938 | Berg | 74/547 |
| 2,978,927 | 4/1961 | Blanton | 138/89 UX |
| 3,242,564 | 3/1966 | Longhini | 29/453 UX |
| 3,305,254 | 2/1967 | Hopkins | 29/453 UX |
| 3,383,945 | 5/1968 | Carella | 74/547 |
| 3,858,823 | 1/1975 | Quenot | 242/84.8 |
| 3,922,790 | 12/1975 | Quenot | 242/84.8 X |

*Primary Examiner*—Charlie T. Moon

[57] ABSTRACT

A crank is attached to a molded plastic member by an axle that serves as a hinge. The member is constructed to be manually deformable sufficiently to allow the axle to be attached to the member. After the axle is secured in position, the member will return to its undeformed state. The crank will then be positively secured to the member without any time consuming alignment or assembly procedures.

4 Claims, 7 Drawing Figures

FIG. 1
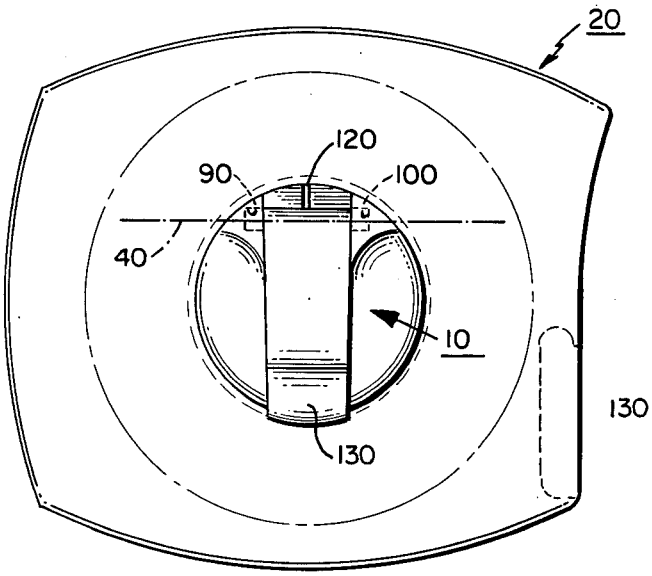
FIG. 5
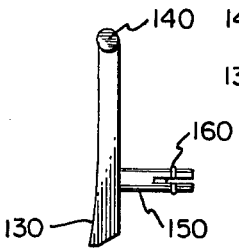
FIG. 6
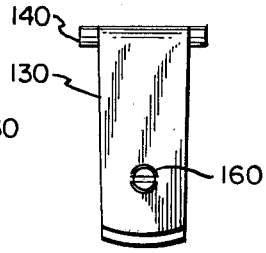
FIG. 7
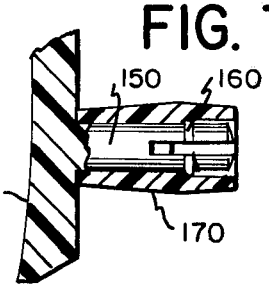
FIG. 3
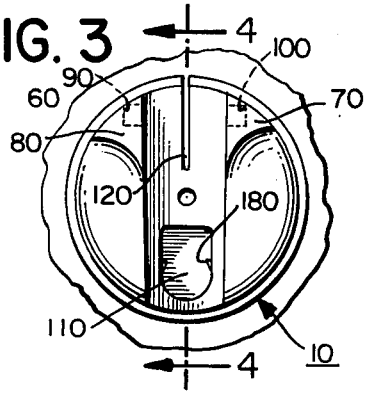
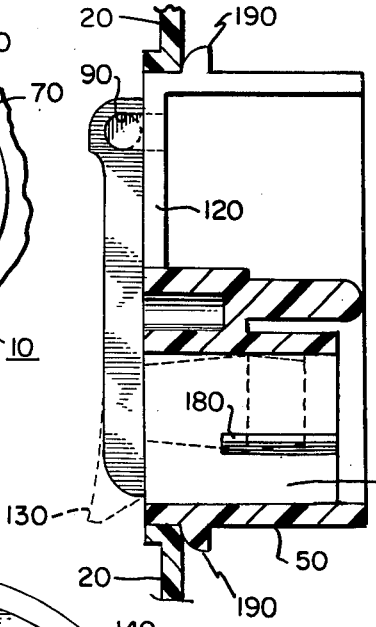
FIG. 4
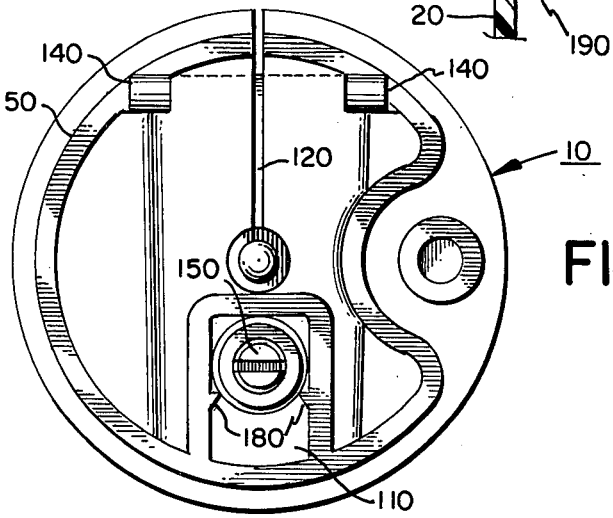
FIG. 2

MOLDED MEMBER FOR USE IN WINDING MECHANISMS

BACKGROUND OF THE INVENTION

Various winding mechanisms, such as those in spring-driven motion picture cameras, roll-type tape measures and the like, utilize fairly long cranks to increase their mechanical advantage and thereby reduce the effort needed for operation. It is customary for such mechanisms to provide a method for folding the crank inwardly when not in use to prevent the crank from getting in the way of the user. A hinge-type construction is often used, wherein an axle that extends transversely through one end of the crank is secured to that piece in the mechanism which transmits the rotation of the crank to the rest of the mechanism.

To this end it is customary to assemble such constructions in a manner requiring manual alignment of the crank and the member. For example, bores may be drilled in the member and crank, the bores may be aligned, and an axle pin may be driven into the bores after the alignment has taken place. Such a procedure is time-consuming and therefore expensive.

SUMMARY OF THE INVENTION

In accordance with the invention, the crank carrying member is so constructed as to be manually deformable to a small extent. The member, when in an undeformed state, has two opposed aligned bores separated only by the width of the crank that is to be used. Deforming the member has the effect of widening the gap between the bores so that both ends of a transverse axle pin that is located in the end of the crank can be placed between them. The deforming force may then be released, whereby the member returns to its undeformed state and the ends of the pin enter the bores, without any tedious alignment procedure. Moreover, the member will become non-deformable once installed in a winding mechanism, thereby insuring a positive hinged attachment of the crank to the member.

BRIEF DESCRIPTION OF THE DRAWINGS

FIG. 1 shows the invention installed in a roll-type tape measure.

FIG. 2 shows the invention as viewed from the interior of the tape measure of FIG. 1.

FIG. 3 shows a top view of the invention without any other parts attached to it.

FIG. 4 shows a side cross-sectional view along line IV, IV of FIG. 3.

FIG. 5 shows a side view of the crank used with the invention in the drawings.

FIG. 6 shows a bottom view of the crank of FIG. 6.

FIG. 7 shows a detail cross-section view of the handle used on the crank.

DETAILED DESCRIPTION OF PREFERRED EMBODIMENTS

Referring now to the drawings, the member is generally indicated by 10 in FIG. 1. It will be understood that the member is an integral structure resulting from the molding of a plastic, and that the various portions are actually part of a single unitary member. Moreover, the specific embodiment here shown is only a typical application for the invention. The member, as understood, in this specification is merely that part of a winding mechanism which transmits the motion of a foldable crank to the mechanism driven by the crank when the crank is in use.

FIG. 1 shows the member used on the housing 20 of a flexible roll-type tape measure. The member is used with a foldable crank 130. It can be seen that the member rotates in a circular hole located in the housing. The crank, as shown in FIG. 1, is in a folded position, where it is out of the way of the user. In order for the member to be easily rotated, the crank will have to be pivoted about the axis of the bore 90 in FIG. 4. In FIG. 1 such pivoting would be observed as bringing the crank up out of the plane of the paper and then back down, rotating about the axis shown as a dashed line 40 in that figure.

The member has a downwardly extending cylindrical wall 50 that is located in the hole in the housing and is just small enough to rotate freely in the hole. On the top of the wall is a generally flat top with a circular periphery.

The top of the member has an elongated flat-bottom channel 60 extending along a diameter of the top. This channel extends between two raised portions 70 and 80. Two opposed, aligned bores 90 and 100 are each located in a corresponding raised portion, the bores extending transversely to the axis of the channel and being located near one end of the channel above the bottom of the channel. A wall 110 is molded to extend downwardly from the bottom of the channel, at the end of the channel remote from the bores.

A vertical slit 120 extends along the axis of the channel and down the wall as shown in FIGS. 2 and 4. This slit goes between the bores and cuts downwardly through the wall at the end of the axis of the channel that is nearest the bores, but the slits stops short of cutting all the way along the channel axis and thereby bisecting the piece. It can be seen that grasping those sections of the wall that are underneath the bores and pulling outwardly will cause the member to deform and the bores to be slightly misaligned and further separated from each other. Releasing the member will allow the piece to revert to its undeformed state.

A crank has a tongue 130 with a flat bottom and the general proportions of the channel. An axle pin 144 molded in the tongue extends transversely through one end thereof. Since the ends of the pin extend outwardly from the sides of the tongue, and the tongue and channel have the same proportions, the member must be deformed as described above in order to allow the pin ends to be fitted into the bores. After the member is released, the crank is pivotally hinged to the member and the crank may be pivoted and folded as described in the beginning of this sections of the specification.

A split post 150 extends downwardly from the bottom of the tongue. The post has a horizontal collar ridge 160 encircling the split part of the post. A hollow elongated almost cylindrical handle 170 has a central bore and a wider recess in the bore near its bottom. The distance from ridge 160 to the tongue is slightly greater than the depth of the bore in the handle above the recess, and the ridge has a greater diameter than the bore and a smaller diameter than the recess. Thus, the handle can be press-fitted on the post, and the split ends of the post will expand so as to retain the handle on the post while permitting the handle to rotate on the post. It is this handle which the user can grasp to rotate the crank. The post is so located that when the crank is folded as is shown in FIGS. 1 and 4, the handle is retained in the well. Flanges 180 extending inwardly inside the well retain the handle therein to enable the crank to remain in closed position after being placed there and facing the user to apply a small amount of pressure to the crank in order to unfold it for use.

An horizontal, annular ridge 190 encircles the wall and extends radially outwardly from it. It can be seen that the distance between the ridge 190 and the periphery of the top is the same as the thickness of the housing. Hence, the member will not pop out of the housing if spring-biased or in any way loaded against the housing. This ridge thus serves two functions, it makes rotation of the piece more uniform, and it also keeps the piece inside the hole in the housing. Since the member when in the hole, cannot deform sufficiently to allow the axle pin to become disengaged from the bores, a positive and secure hinged connection between the crank and the member is achieved.

I claim:

1. A device for use in winding mechanism comprising:

a member with a downwardly extending cylindrical wall and a top with a circular periphery, the top having an elongated channel with a flat bottom extending along one of its diameters and dividing it into two like raised portions, each of these portions having a bore extending from the periphery of the top to the edge of the channel with the axes of the top being horizontally coincident and perpendicular to the axis of the channel and being located above its bottom and near one of its ends, the member further having a central vertical slit extending downwardly through the top and the wall along an imaginary line which begins at a point along the bottom of the wall, then runs vertically upwardly along the wall to a point of intersecion of the end of the channel axis adjacent the bores and the periphery of the top, and then runs along the channel axis between the bores and through the center of the top to terminate at a point between the center of the top and the end of the channel axis remote from the bores.

2. The device of claim 1, wherein the member is further characterized by an annular ridge extending horizontally around the wall and extending radially outwardly from it.

3. The device of claim 2, wherein the member is made of plastic.

4. The device of claim 3 wherein the member when manually deformed assumes a momentary position at which said bores are misaligned and exhibit an additional separation.

* * * * *